United States Patent [19]

Davison

[11] Patent Number: 4,686,658

[45] Date of Patent: Aug. 11, 1987

[54] SELF-ADJUSTING VALVE ACTUATOR

[75] Inventor: Francis L. Davison, Houston, Tex.

[73] Assignee: NL Industries, Inc., New York, N.Y.

[21] Appl. No.: 654,188

[22] Filed: Sep. 24, 1984

[51] Int. Cl.[4] ..... G01V 1/137; F16K 31/02

[52] U.S. Cl. ..... 367/85; 137/487.5; 340/861; 340/870.39; 361/152; 367/912

[58] Field of Search ..... 367/83–85, 367/190, 912; 340/861, 870.3, 870.39; 361/152–154, 170, 178; 33/306, 307; 175/50, 48, 40; 166/66; 137/486, 487, 487.5, 606; 251/129.1, 129.01; 307/358, 352

[56] References Cited

U.S. PATENT DOCUMENTS

| | | | |
|---|---|---|---|
| Re. 30,559 | 3/1981 | Schmitt | 137/606 X |
| 2,869,475 | 1/1959 | Bobo | 417/111 |
| 3,302,457 | 2/1967 | Mayes | 367/83 |
| 3,389,355 | 6/1968 | Schroader | 310/14 |
| 3,705,603 | 12/1972 | Hawk | 340/853 |
| 3,875,955 | 4/1975 | Gallatin et al. | 137/487 X |
| 3,952,759 | 4/1976 | Ottenstein | 137/487.5 X |
| 3,958,217 | 5/1976 | Spinnler | 367/83 |
| 4,078,620 | 3/1978 | Westlake | 367/83 |
| 4,134,100 | 1/1979 | Funke | 181/119 |
| 4,266,606 | 5/1981 | Stone | 367/85 X |
| 4,323,991 | 4/1982 | Holmes | 367/83 |
| 4,336,564 | 6/1982 | Wisniewski | 367/85 |
| 4,345,737 | 8/1982 | Kawai et al. | 361/152 X |
| 4,351,037 | 9/1982 | Scherbatskoy | 367/85 |
| 4,417,312 | 11/1983 | Cronin et al. | 137/487.5 X |
| 4,565,212 | 1/1986 | Klein et al. | 137/487.5 X |

*Primary Examiner*—Deborah L. Kyle
*Assistant Examiner*—John E. Griffiths
*Attorney, Agent, or Firm*—Browning, Bushman, Zamecki & Anderson

[57] ABSTRACT

The present invention is directed to an apparatus and method for actuating a valve. The present invention is particularly useful with a valve for imparting pressure pulses in a pressure pulse telemetry system. The present invention relates to an apparatus and method for actuating a valve from a first to a second position wherein the actuating force is adjusted in response to a measured value characteristic of the minimum force necessary to actuate the valve. The apparatus and method of the present invention advantageously and beneficially reduces the power requirement for actuating the valve, prolonging battery life, and minimizes the deleterious affects of excess mechanical and electrical energy on the valve and circuit components, prolonging valve and circuit life.

17 Claims, 4 Drawing Figures

SELF-ADJUSTING VALVE ACTUATOR

BACKGROUND OF THE INVENTION

1. Field of the Invention

The present invention generally relates to an apparatus and method useful for actuating a valve. The present invention is particularly useful for actuating a valve incorporated in a drill string for use in a pressure pulse telemetry system. More particularly, the present invention relates to an apparatus and method for adjusting the actuating force applied to a valve in response to a value characteristic of the minimum force necessary to actuate the valve.

2. Description of the Background

The desirability of logging a borehole during or immediately after drilling has long been recognized by those associated with drilling operations. However, borehole logging for many years was exclusively performed by wireline tools lowered into the borehole after removal of the drilling apparatus therefrom. These wireline logging operations, requiring the tripping of the drill string, resulted in lost drilling time and greatly increased costs. Further, changes in various formation characteristics occurred during the delay between the actual drilling of a formation and the performance of these wireline logs. For example, leakage of drilling fluids or formation fluids across the borehole wall during this delay time often resulted in the production of inaccurate and incorrect logs.

For many reasons, including those set forth above, those skilled in the art have long recognized the desirability of performing borehole logging operations while drilling. However, in recent years, there has been significant interest in the development and use of measurement-while-drilling (MWD) systems. Only recently have appropriate tools and methods to perform logging operations while drilling became available. The actual measurement tools must be resistant to the harsh environment created by the constantly vibrating drill string and the prolonged exposure to borehole conditions. Further, these tools must be sufficiently strong to withstand the stresses in the drill string and sufficiently small to not interfere with the operation of the drill string and its associated downhole systems.

MWD systems require apparatus and methods for transmitting the measured data to the surface. Although it is theoretically possible to store the data in a microcomputer or other downhole data storage device for transfer to appropriate data processing devices at the surface upon retrieval from the borehole, these systems have not found widespread use. In order to maximize the benefits from MWD systems, it is necessary to transmit the data immediately to the surface for analysis. Contemporaneous analysis permits the drilling operator and geologist to immediately detect changes in the bottom hole conditions and to make any desirable or necessary adjustments in the drilling operation. Accordingly, apparatus and methods for telemetering MWD data to the surface are necessary. Telemetry systems employed have included systems for transmitting electrical signals through electrical conductors embedded in or on the drill string, systems for transmitting acoustic signals through the drill string or the drilling fluids and systems for imparting measurable pressure pulses to the drilling fluids.

Pressure pulse telemetry systems include apparatus and methods for imparting either negative or positive pressure pulses to the relatively constant drilling fluid pressure in the central bore of the drill string. An exemplary apparatus and method for telemetering information from a borehole to the surface by negative pressure pulse telemetry is disclosed in U.S. Pat. No. 4,078,620 which is incorporated herein by reference. This exemplary system discloses a system for venting.drilling fluid through a passage in the wall of a drill sub from the interior of the sub to the annulus in order to impart negative pulses to the pressure of the drilling fluid in the drill string. These negative pulses transmit coded information from the borehole location to the surface where the negative pulses are detected and the data decoded.

In a downhole pressure pulse telemetry system employing an electrically operated valve or pulser, the force required to actuate the valve varies with the downhole differential pressure across the valve. The power supply must be designed to provide an energy output to produce an actuating force sufficient for the worst expected condition. Because energy is wasted in all but the extreme condition, these systems suffer from significant energy waste. This wasting of energy in significant quantities is detrimental for two major reasons. The wasted electrical energy requires the use of a larger power supply than is actually necessary to operate the valve. Power supplies generally comprise downhole batteries or electrical generators. Because it is desirable to maintain the power supply as small as possible, it would be advantageous to minimize this wasted energy. Further, the wasted mechanical energy generated by applying a constant, maximum actuating force to the valve must be dissipated in the pulser assembly. This energy is dissipated as excess heat and as accelerated wear through fatigue and breakage as the result of unnecessarily severe shock and vibration to the moving components of the solenoid and valve assembly, both contributing to a shortened lifetime for the assembly.

Because the downhole pressures typically encountered by these systems are quite high and because the pressure differential between the interior and exterior of the drill string in these locations is also quite high, the design and operation of the telemetry signaling valve is critical. These valves must seal accurately to prevent fluid leakage, they must be fast acting to produce sharp pressure pulses and they must require minimum energy to operate. The successful, long-term operation of these systems has suffered from difficulties in meeting the above requirements.

Whether the electrical power is supplied by a downhole battery or by an electrical generator in the drill string, it is desirable to minimize the electrical needs of the valve system in order to prolong battery life or minimize the size of the needed generator. Others skilled in the art have attempted to solve this problem by various means. For example, U.S. Pat. No. 3,958,217 discloses a positive pulse telemetry system employing a small input signal to operate a pilot valve whereby the main telemetry valve is then operated by pressure differentials created in the mud stream itself. U.S. Pat. No. 4,336,564 discloses a negative pulse telemetry system including solenoid control circuitry for initially providing a large current to the solenoid to open the valve, for reducing the current to a much smaller value to hold the valve open and for interrupting the current to close the valve. U.S. Pat. No. 4,351,037 discloses a system employing back coupled solenoids to open and close the valve so that the only energy required is that necessary to actuate the valve. These systems have attempted to minimize the total energy requirement necessary to operate the valve. Of particular concern was the need to minimize the long term energy necessary to maintain the valve open in order to prevent burn up of the opening solenoid.

Although increased pressure differential across the valve in a negative pressure pulse telemetry system may be useful to prevent leakage through the valve, the force necessary to actuate the valve is also directly related to the pressure differential across the valve. Because it is necessary to ensure that these pressure pulse telemetry systems function under the most severe borehole conditions expected, sufficient force and power to actuate the valve under the most severe, expected conditions must be available.

Accordingly, the valves in pressure pulse telemetry systems have been overpowered to ensure operation under the most severe, expected conditions. By always operating the valve with a force sufficient to overcome the most severe, expected conditions, the lives of the various valve and electrical circuit components have been shortened by dissipation of the excess mechanical and electrical energy applied in most operations. Although the above patents disclose attempts to minimize the total energy requirements necessary to operate pressure pulse telemetry valves, they do not disclose attempts to minimize the initial force applied to actuate the valve to minimize this wear.

Accordingly, there has been a long felt but unfilfilled need within the borehole logging industry for an apparatus and method useful in pressure pulse telemetry systems for actuating the pressure pulse imparting valve with the minimum necessary force in order to both conserve critical downhole energy supplies and minimize the wear on valve and circuitry components.

SUMMARY OF THE INVENTION

The present invention provides a new and improved apparatus and method for actuating a valve. The disclosed apparatus and method provide a means for actuating a valve with the minimum force necessary in order to minimize the actuating and operating power required and to minimize both mechanical wear through fatigue and breakage due to unnecessary shock and vibration on the movable valve components and deterioration of the operating circuitry through dissipation of excess heat. The disclosed system is particularly useful in connection with pressure pulse telemetry systems and methods wherein the present invention is advantageously employed with a valve means in a downhole drill sub for imparting pressure pulses to the drilling fluid.

An apparatus in accord with the present invention useful for actuating a valve comprises means for actuating the valve from a first to a second position, means for obtaining a value characteristic of the minimum force necessary to actuate the valve and means for adjusting in response to the obtained value the actuating force applied to the valve. Preferably, the characteristic value is obtained by measuring a physical characteristic affecting the minimum force necessary to actuate the valve. Most preferably, this value is obtained by measuring the pressure differential across the valve. The valve is conveniently electrically actuated, e.g., by a solenoid powered by a conventional direct current power source such as a battery or downhole power generator. Although a single solenoid actuator is sufficient, the presently preferred embodiment employs back coupled solenoids to produce a bi-stable or toggle valve. The power supplied to the electrical actuating means is adjustable by any conventional means to adjust the actuating force applied to the valve in response to the value characteristic of the minimum, necessary actuating force. For example, the power supplied and force applied is easily adjusted by appropriate electrical circuitry to adjust the level of the voltage or the current supplied to the actuating solenoid. In the presently preferred embodiment, a pair of pressure transducers is arranged on opposite sides of the valve in order to measure the pressure differential across the valve. The pressure differential across the valve controls a regulator to control the voltage or current applied to the actuating solenoid. In the presently preferred embodiment, a switching regulator is employed for increased efficiency and flexibility.

The valve actuating mechanism of the present invention is advantageously employed together with a valve means in a drill sub suitable for incorporation in a drill string to impart pressure pulses to the fluid in the drill string. This device is particularly useful in a pressure pulse telemetry system also including a means for maintaining a fluid under pressure in the central bore of the drill string and a means for measuring the imparted pressure pulses in the fluid at a second location, preferably the surface.

The apparatus and method of the present invention solve a long felt but unfulfilled need of the MWD industry for an apparatus and method for minimizing both the initial and the total electrical power needed to actuate a valve for imparting measurable pressure pulses in a pressure pulse telemetry system and for minimizing the mechanical wear on the movable valve components and deterioration of the operating circuitry. The apparatus and method of the present invention provide the desired advantages by obtaining a value characteristic of the minimum force necessary to operate the valve, preferably by measuring a physical characteristic indicative of that force, most preferably the pressure differential across the valve, and adjusting the power applied to actuate the valve in response to the value. These and other meritorious features and advantages of the present invention will be more fully appreciated from the following detailed description and claims.

BRIEF DESCRIPTION OF THE DRAWINGS

Other features and intended advantages of the present invention will be more readily apparent by the references to the following detailed description in connection with the accompanying drawings, wherein.

While the invention will be described in connection with the presently preferred embodiment, it will be understood that it is not intended to limit the invention to this embodiment. On the contrary, it is intended to cover all alternatives, modifications and equivalents as may be included in the spirit of the invention as defined in the appended claims.

DETAILED DESCRIPTION OF THE PREFERRED EMBODIMENT

The present invention is directed to an apparatus and method useful for adjusting the power supplied to a mud pulse telemetry valve. In the most presently preferred embodiment, the apparatus and method of the present invention adjust the supply power based upon measurements of the pressure differential across a valve, e.g., in the borehole and the annulus.

The present invention comprises an apparatus and method for automatically varying the power supplied to the pulser valve to provide a force just sufficient to operate the valve, including an insurance factor. The strategic measurement of absolute pressures or differential pressure across the valve provides data indicative of the minimum required force to actuate the pulser valve. The power supplied to the pulser valve is regulated by control of one or more of the voltage, current or time of the electricity supplied to the valve. In the presently preferred embodiment, the desired power regulation is achieved by regulating the voltage supplied to the valve through a switching voltage regulator. The switching voltage regulator by regulating the supplied voltage advantageously minimizes power usage, mechanical wear from fatigue and breakage due to unnecessary shock and vibration, deterioration of the operating circuitry and valve components by dissipation of excess heat and other deleterious affects on the valve and operating circuitry components. A switching current regulator would be similarly advantageous by regulating the current supplied to the pulser valve. Other means for minimizing the power used, e.g., simply controlling the time the actuating current is applied to the valve assembly would not be as effective in reducing mechanical wear and other deleterious affects on the valve and operating circuitry components. An apparatus and method in accord with the present invention will effectively operate a pressure pulse telemetry valve, while conserving the valuable supply of downhole electrical energy. Accordingly, battery life and system operating time between battery replacement is increased. Alternatively, the size of a downhole electrical generator used in conjunction with an appropriate electrical storage means, e.g., a capacitor, is minimized. Further, by minimizing the actuating force applied to the pulser valve, the life of the expensive valve components is increased by minimizing the excess mechanical energy and heat dissipated therein.

Figures 1, 4:
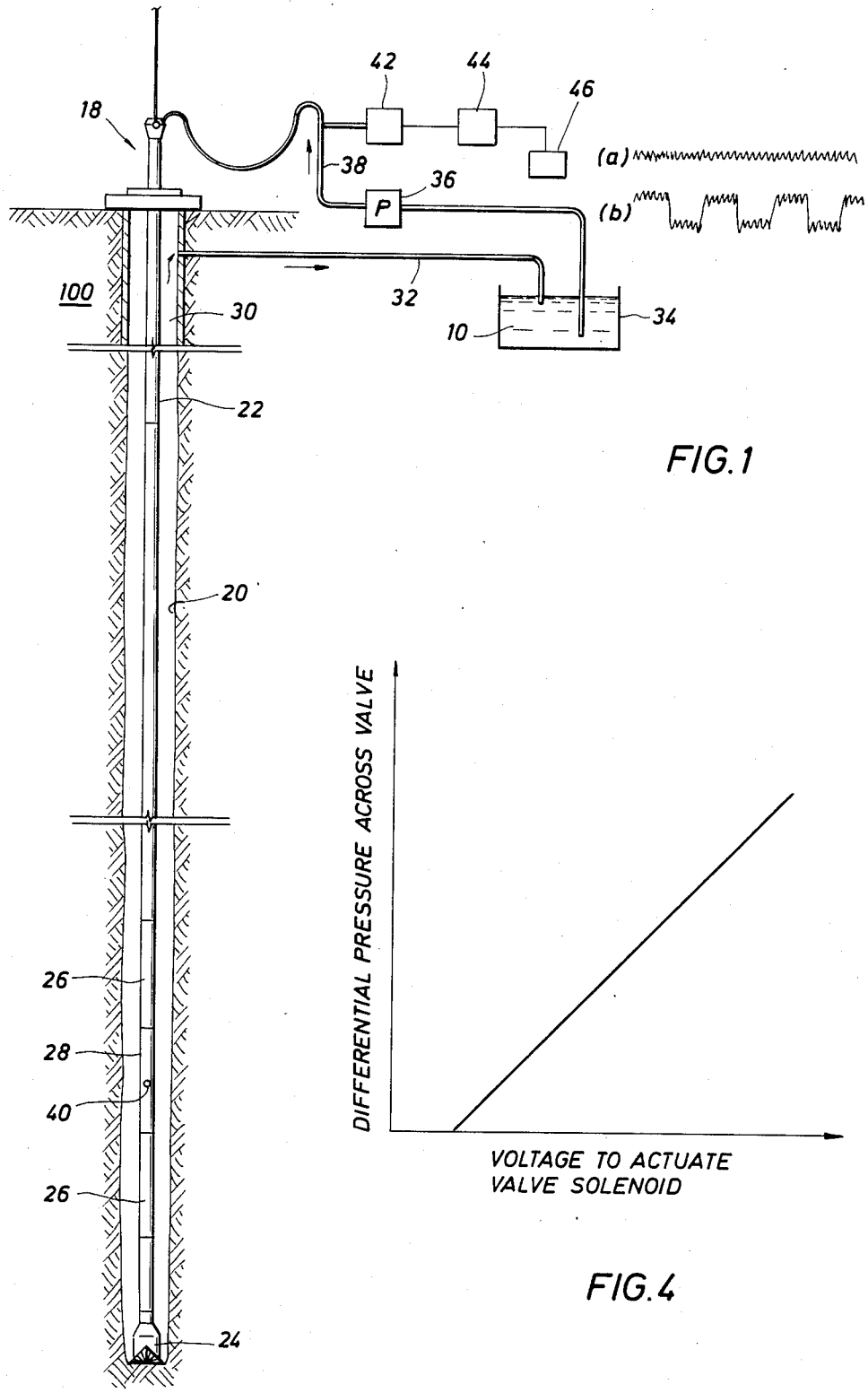
FIG. 1 is a schematic illustration of a well bore including a drill string and pressure pulse telemetry system in accord with the present invention.
FIG. 4 is a graphical illustration of the relationship between the pressure differential across the valve of the system of FIG. 2 and the voltage applied to the actuating solenoid in a system in accord with the present invention.

FIG. 1 illustrates schematically a pressure pulse telemetry system for transmitting data from a location near the drill bit 24 to a sensor 42 at the surface by imparting negative pressure pulses to the drilling mud 10 within the drill string 22. The apparatus and method of the present invention are conveniently and advantageously employed in this system. FIG. 1 illustrates a drilling apparatus 18 including a drill string 22 having a drill bit 24 attached to the end thereof for penetrating the earth 100 to produce a borehole 20. The drill string 22 often includes one or more drill collars 26 located proximate the drill bit 24 and having therein sensors or other devices for determining one or more of a plurality of characteristics near the bottom of the borehole of the drilling mud, of the drill string penetrating the formation or of the formation through which the drill string is penetrating. Typically, these sensors determine information useful to the drilling operator or geologist, e.g., the resistivity or porosity of the formation, the density of the drilling fluid in the annulus, the borehole pressure, the borehole temperature, the weight-on-bit the torgue-on-bit, the acceleration, the bending moment and the like. The data derived by these instruments must be communicated to the surface. Data transmission methods include electrical and acoustic telemetry systems within the drill string. However, pressure pulse telemetry employing the already existing pressurized drilling mud system is becoming increasingly favored.

In order to prevent blowouts, it is necessary to compensate for the weight of the earth removed by the drilling process and to balance the bottom hole pressures. Further, it is necessary to remove the borehole cuttings and to cool the drill bit. These problems are all solved by conventional drilling mud systems which pressurize a drilling fluid or mud 10 in a conduit 38 by a pump 36, circulate the mud down a central bore 48 through the drill string 22, expel the mud through openings in the drill bit 24 and return the mud to the surface through the annulus 30 between the drill string 22 and the borehole 20. The mud 10 returns to a mud pit 34 from the borehole 20 through a conduit 32. The pressure of the drilling fluid 10 within the conduit 38 and the drill string 22 is maintained at a predetermined level by the pump 36 with only slight variations in pressure caused by the pump strokes. This pressure level is illustrated by the simulated pressure reading at (a) in FIG. 1.

A borehole pressure pulse telemetry system operates by imparting measurable pressure pulses, either negative or positive, on the relatively steady pressure maintained by the drilling fluid pump. For example, the trace of (b) is illustrative of measurable pressure pulses superimposed on the base pressure by a pressure pulse telemetry system. FIG. 1 illustrates schematically the rudimentary parts of a negative pressure pulse telemetry system. In addition to the drill string and drilling fluid system previously described, a negative pressure pulse telemetry system comprises a drill section 28 having therein a gated passageway 40 to permit diversion of a portion of the drilling mud 10 from the interior of the drill string 22 to the annulus 30, resulting in a temporary drop in the pressure in the interior of the drill string 22. This temporary negative pressure pulse is measurable at the surface by pressure transducer 42 in pressure communication with the pressurized drilling fluid in the drill string 22 and the conduit 38. This measured pressure data is conveniently stored and processed in a computer 44 or other conventional data handling device and/or displayed by a strip chart recorder 46 or other conventional display device.

Figure 2:
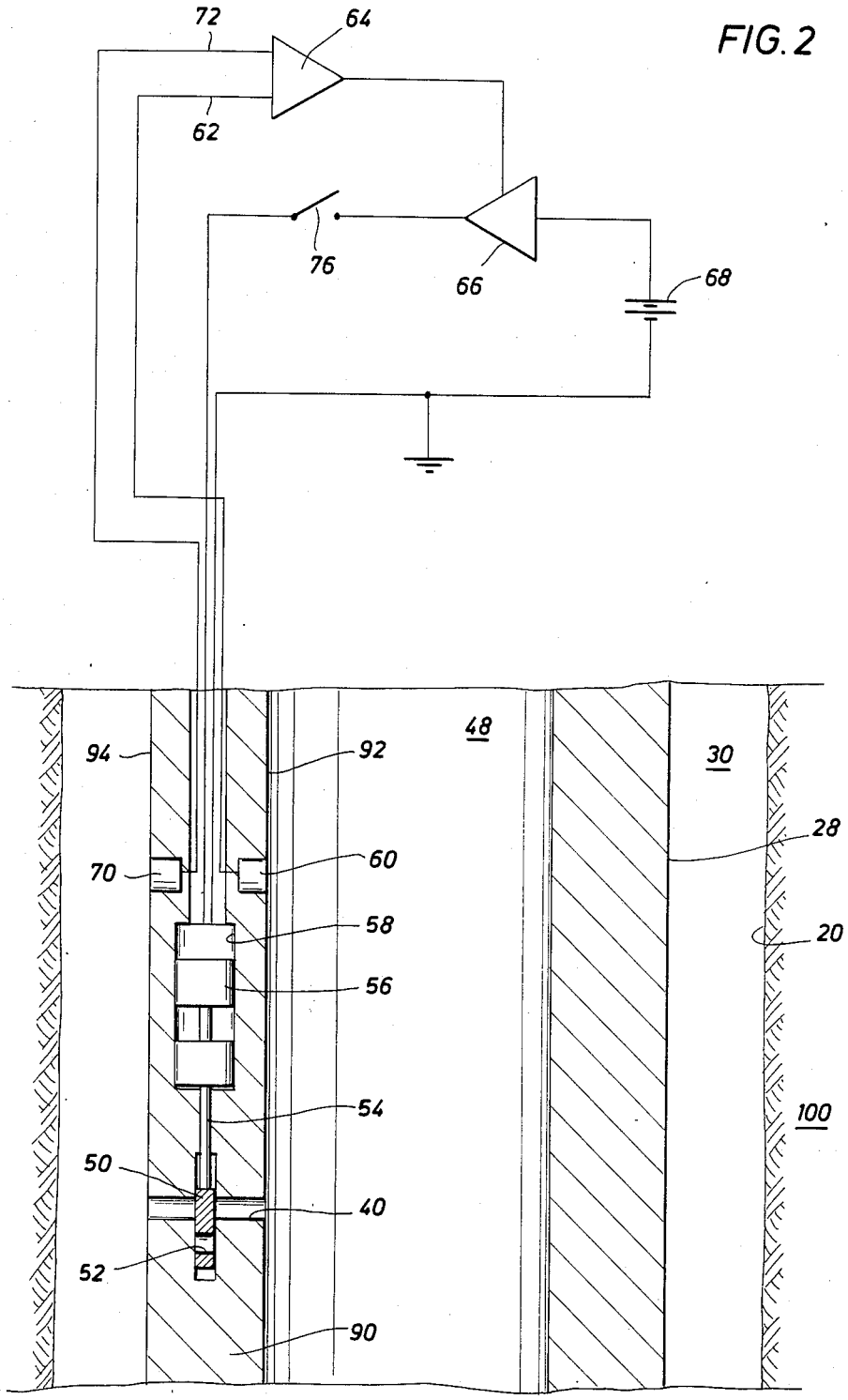
FIG. 2 is a schematic illustration of a gate valve and actuating system including a diagramatic electrical circuit in accord with the present invention.
Figure 3:
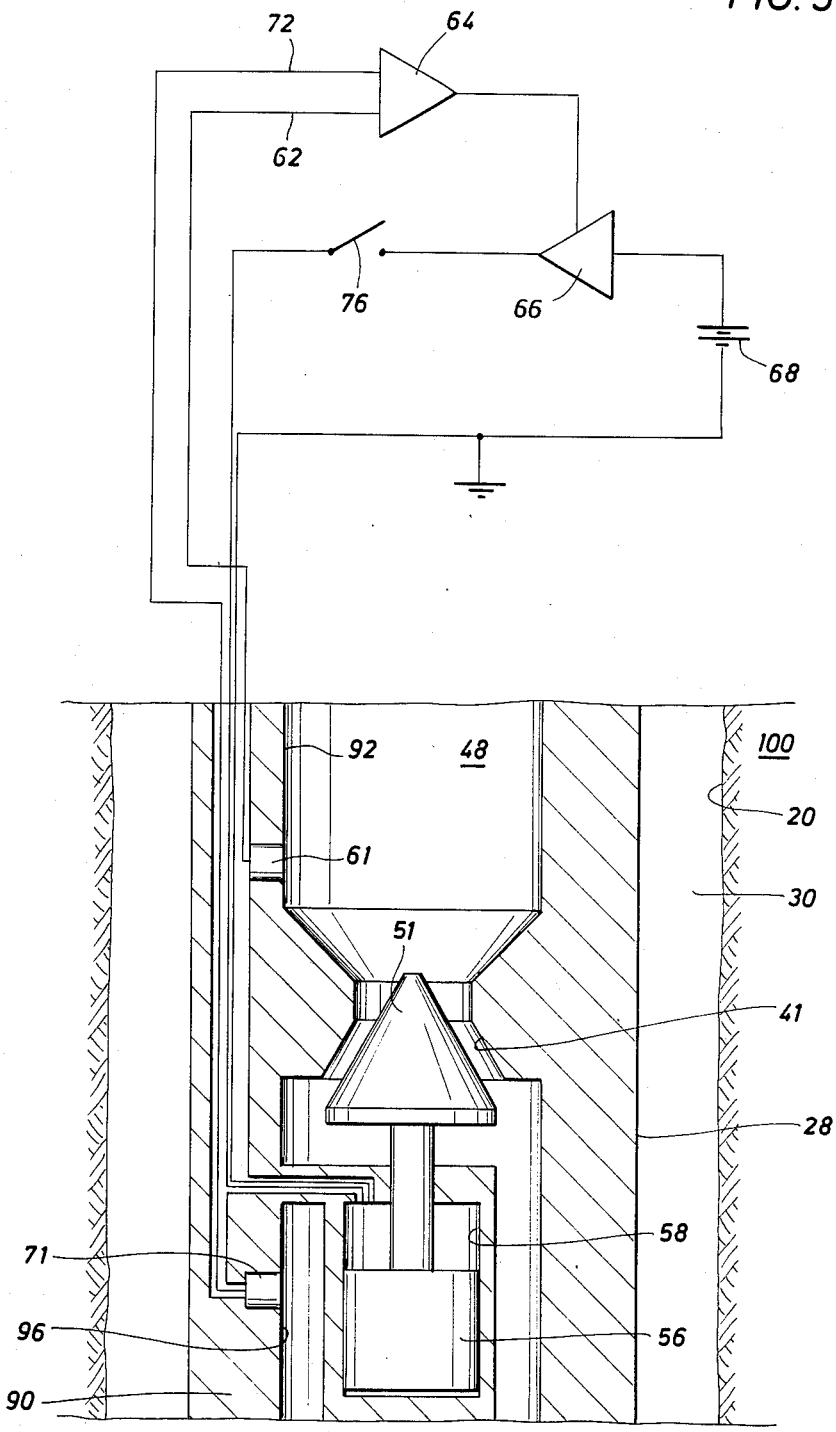
FIG. 3 is a schematic illustration of a poppet valve and actuating system including a diagramatic electrical circuit in accord with the present invention.

An apparatus for actuating a valve and particularly useful for incorporation in a drill sub suitable for incorporation into a drill string for use in a pressure pulse telemetry system is illustrated schematically and in more detail in FIGS. 2 and 3. FIG. 2 illustrates an apparatus useful in a negative pressure pulse telemetry system; FIG. 3 illustrates an apparatus useful in a positive pressure pulse telemetry system.

FIG. 2 illustrates a device useful for modulating the flow of drilling fluid from a central bore 48 in drill sub 28 to the annulus 30 between the drill sub and the borehole 20 in the formation 100. In this negative pressure pulse telemetry system, a portion of the drilling fluid 10 passing through the central bore 48 is permitted to exit through side wall bore 40 in the wall 90 of the drill sub 28 to the annulus 30 to produce a temporary negative pressure pulse. Those skilled in the art are aware of many suitable gate valves useful in downhole applications to produce the desired negative pressure pulses. An exemplary gate valve 50 including a bore 52 therethrough for cooperation with the side wall bore 40 in the open position is movable through a plane perpendicular to the side wall bore 40. Exemplary gate valves are illustrated and described in greater detail in co-pending U.S. patent application Ser. No. 460,461 and U.S. Pat. No. 3,389,355 which are incorporated herein by reference. The gate valve 50 is mechanically linked through a rod 54 to a means for actuating the valve between its open and closed positions. Those skilled in the art are aware of many suitable actuating mechanisms, including various arrangements of solenoids. Exemplary actuating means comprises a solenoid or more preferably a pair of back coupled solenoids 56 to actuate the gate valve 50 between the open and closed positions. Exemplary solenoid valve actuating means are illustrated and described in greater detail in co-pending U.S. patent application Ser. No. 461,649 and U.S. Pat. No. 2,869,475 which are incorporated herein by reference. The actuating mechanism and control circuitry are located within one or more cavities 58 in the wall 90 of the drill sub 28. Those skilled in the art will appreciate the means by which these cavities are formed and the instrumentation placed and sealed therein. However, in general, these cavities are formed by appropriate grooves or recesses in the exterior wall of the drill sub 28 into which the desired instrumentation is placed and which are then sealed by appropriate covers.

The apparatus further comprises means for obtaining a value characteristic of the minimum force necessary to actuate the valve. Preferably, this value is obtained by measuring a physical characteristic affecting the minimum force. Because the pressure differential across the valve is related to the minimum force necessary to actuate the valve, most preferably, the pressure differential across the valve is measured. This pressure differential is readily measured by a pair of conventional pressure transducers located on opposite sides of the valve 50. For example, a pressure transducer 60 is located along the interior surface 92 of the wall 90 of the drill sub 28 to measure the pressure of the drilling fluid within the central bore 48. Similarly, a pressure transducer 70 is located on the exterior surface 94 of the wall 90 of the drill sub 28 to measure the pressure of the fluids in the annulus 30.

The apparatus further comprises means for adjusting the actuating force applied to the valve in response to the value characteristic of the minimum force necessary to actuate the valve. Although this device is most useful in minimizing the power expended to open gate valve 50, it is also useful in minimizing the power expended to close the valve 50. FIGS. 2 and 3 schematically illustrate the circuitry of an exemplary adjustment means. Electrical signals indicative of the interior and exterior pressures measured by the pressure transducers 60 and 70, respectively, are carried along electrical conductors 62 and 72, respectively, to a difference amplifier 64. The power to actuate the valve is supplied by a battery 68 or other conventional power source, e.g., a downhole mud turbine or piezoelectric generator. The power drawn from the battery 68 is adjusted by a voltage switching regulator 66 in response to the output of the difference amplifier 64. The actual application of this adjusted electrical power to the actuating solenoids 56 is controlled by a logic switch 76 in accord with conventional downhole equipment and circuitry to send the desired signals to the surface. Alternatively, the power may be adjusted in response to the measured value by a current switching regulator or other means known by those skilled in the art for adjusting the applied power so long as the applied power is sufficient to generate an actuating force greater than the minimum force necessary to actuate the valve.

The actuating force developed by the valve must be at least as great as the minimum force necessary to actuate the valve and preferably is somewhat greater in order to provide a safety or insurance factor. The force developed is directly related to the voltage or current applied to the solenoid, which in turn is directly related to the pressure differential across the valve. The differential pressure and actuating voltage are directly, although not necessarily linearly or proportionally, related in a definable or measurable manner. FIG. 4 illustrates the relation between the pressure differential and the solenoid actuating voltage for the apparatus of FIG. 2. In this example, the differential pressure and actuating voltage are directly and linearly proportional.

FIG. 3 illustrates an apparatus in accord with the present invention useful for producing positive pressure pulses in a pressure pulse telemetry system. The electrical circuitry described above is used to adjust the electrical power applied to the valve as discussed above and, accordingly, the actuating force developed by the valve. This system comprises a poppet valve 51 disposed within the central bore 48 of a drill sub 28 for momentary cooperation with face 41 to temporarily inhibit the flow of fluid through the central bore 48 to produce positive pressure pulses measurable at the surface. The device further includes a single actuating solenoid 56 or a pair of appropriately interconnected solenoids to actuate the valve 51 through linking rod 54. When employing a single solenoid 56 to close the valve 51, the valve is opened by mere de-activation of the solenoid, together with the effects of gravity and the flow of the fluid column within the drill string 22 above the valve 51. Alternatively, a pair of back coupled solenoids 56 is employed to actuate the valve 51 to both its closed and open positions in a bi-stable manner. Operating solenoids and controlling electrical circuitry are disposed within appropriate cavities 58 within the wall 90 of the drill sub 28 or within conventional inserts suspended within the central borehole by means well known to those skilled in the art. The exemplary device further comprises a pair of conventional pressure transducers 61 and 71 disposed in the wall 90 of the drill sub 28 on opposite sides of the valve 51 as along wall 92 above the valve 51 and the wall 96 below the valve 51. Because the central bore 48 through the drill string 22 is in communication with the low pressure annulus through the drill bit on the lower side of the illustration, the pressure measured by the transducer 71 will be less than that measured by the transducer 61. The power applied to the valve 51 and the force developed is adjusted in response to the pressure differential measured by the transducers 61 and 71 by electrical power and control devices and circuitry identical to that described above in relation to the apparatus of FIG. 2. In an alternative apparatus, transducers 61 and 71 are replaced by conventional flow measurement devices or any other device capable of measuring a value related to the minimum force necessary to actuate the valve 51.

A pressure pulse telemetry system useful for transmitting signals through the drilling fluid in a borehole comprises a device in accord with the present invention incorporated within a drill string 22 in a borehole 20 and further comprises a pump 36 or other means for maintaining the drilling fluid 10 within the central bore 48 of the drill string 22 under pressure. Finally, this telemetry system comprises a pressure transducer 42 or other means to measure the pressure of the drilling fluid 10 within the drill string 22 at the surface and a computer 44 and/or strip chart recorder 46 or other appropriate means for storing, manipulating or displaying these results.

The method of the present invention for actuating a valve means comprises obtaining or measuring a value characteristic of the minimum force necessary to actuate the valve, adjusting the actuating force applied to the valve in response to the obtained or measured value and actuating the valve with the adjusted, actuating force. In the preferred method, the value is obtained by measuring a physical characteristic, most preferably, the pressure differential across the valve means. In the preferred method, the valve is actuated electrically and the electrical power supplied to the actuating means is adjusted in response to the obtained or measured value. Although those skilled in the art will appreciate that the actuating force is adjustable by many means, in the presently most preferred method, the voltage applied to the valve actuating means is adjusted.

The foregoing description of the invention has been directed in primary part to a particular preferred embodiment and method in accordance with the requirements of the patent statutes and for purposes of explanation and illustration. It will be apparent, however, to those skilled in the art that many modifications and changes in the specifically described apparatus and method may be made without departing from the scope and spirit of the invention. For example, Applicant has illustrated and described devices and methods useful in both negative and positive pressure pulse telemetry systems based on measurement of the pressure differential across the valve. Those skilled in the art will appreciate that other values characteristic of or related to the minimum force necessary to actuate the valve may be obtained or measured. It may even be possible to preprogram the adjustments of actuating force based on expected borehole conditions, although adjustments based on actual measured conditions are clearly preferable. Therefore, the invention is not restricted to the particular form of construction and method illustrated and described, but covers all modifications which may fall within the scope of the following claims.

It is applicant's intention in the following claims to cover such modifications and variations as fall within the true spirit and scope of the invention.

What is claimed is:

1. A method for transmitting signals through a fluid comprising:

maintaining said fluid under pressure;

obtaining a value characteristic of the minimum force necessary to actuate a valve means in communication with said fluid at a first location;

adjusting in response to said value the actuating force applied to said valve means;

actuating said valve means with said minimum actuating force to impart a pressure pulse to said fluid at said first location; and detecting said pressure pulse in said fluid at a second location.

2. The method of claim 1 wherein said value is obtained by measuring a physical characteristic affecting said minimum force.

3. The method of claim 2 wherein said measuring comprises measuring the pressure differential across said valve means.

4. The method of claim 3 wherein said actuating comprises actuating said valve means with a solenoid actuated by electrical power and wherein said adjusting comprises adjusting said electrical power supplied to said solenoid.

5. A pressure pulse telemetry system useful for transmitting signals through a drilling fluid in a central bore of a drill string in a borehole, comprising:

a drill string having a central bore therethrough;

means for maintaining a fluid under pressure in said central bore of said drill string;

a drill sub incorporated into said drill string at a first location;

valve means in said drill sub;

means for actuating said valve means for imparting a pressure pulse to said fluid in said drill string;

means for obtaining a value characteristic of the minimum force sufficient to actuate said valve means;

means for adjusting to said minimum sufficient to actuate said valve means the actuating force applied to said valve means in response to said value; and means for measuring the pressure pulse imparted to said fluid in said drill string at a second location.

6. The apparatus of claim 5 wherein said means for obtaining comprises means for measuring a physical characteristic affecting said minimum force.

7. The apparatus of claim 6 wherein said means for measuring comprises means for measuring the pressure differential across said valve means.

8. The apparatus of claim 7 wherein said means for actuating comprises an electrical powered, solenoid actuating means and wherein said means for adjusting comprises means for adjusting the electrical power supplied to said actuating means.

9. An apparatus useful in a pressure pulse telemetry system, comprising:

a drill sub suitable for incorporation into a drill string and having a central bore therethrough permitting flow of drilling fluid;

valve means in said drill sub;

means for actuating said valve means for imparting a pressure pulse to drilling fluid in said central bore of said drill sub;

means for obtaining a value characteristic of the minimum force sufficient to actuate said valve means; and means for adjusting to said minimum sufficient to actuate said valve means the actuating force applied to said valve means in response to said value.

10. The apparatus of claim 2 wherein said means for obtaining comprises means for measuring a physical characteristic affecting said minimum force for obtaining said value.

11. The apparatus of claim 10 wherein said means for measuring comprises means for measuring the pressure differential across said valve means.

12. The apparatus of claim 10 wherein said valve means comprises poppet valve means in said central bore of said drill sub for imparting a positive pressure pulse.

13. The apparatus of claim 9 wherein said means for actuating comprises a solenoid for actuating said valve means and an electrical power source for supplying electrical power to said solenoid.

14. The apparatus of claim 13 wherein said means for adjusting comprises means for adjusting said electrical power supplied to said solenoid.

15. The apparatus of claim 14 wherein said means for adjusting said power comprises means for adjusting the electrical current supplied to said solenoid.

16. The apparatus of claim 14 wherein said means for adjusting said power comprises means for adjusting the electrical voltage supplied to said solenoid.

17. An apparatus useful in a pressure pulse telemetry system for transmitting data through a borehole, comprising:

a tubular drill sub having an exterior, having a central, longitudinal bore therethrough and having threaded ends suitable for incorporation into a drill string;

a passage through the wall of said drill sub to connect said central bore and said exterior of said drill sub;

a shear valve in said passage for opening and closing said passage;

a solenoid for applying an actuating force to said valve for actuating said valve between an open and a closed position;

mechanical means linking said solenoid to said valve for actuating said valve;

an electrical power source for supplying actuating power to said solenoid;

electrical conductor means for linking said power source to said solenoid for actuating said solenoid;

a plurality of pressure transducers disposed on said drill sub in a pattern permitting measurement of the pressure differential across said valve; and regulator means for varying the electrical power supplied to said solenoid from said power source in response to the output of said pressure transducers, said regulator means minimizing said actuating force applied by said solenoid while producing sufficient said force actuating said valve.

* * * * *

UNITED STATES PATENT AND TRADEMARK OFFICE

CERTIFICATE OF CORRECTION

PATENT NO. : 4,686,658

DATED : August 11, 1987

INVENTOR(S) : Francis L. Davison

It is certified that error appears in the above-identified patent and that said Letters Patent is hereby corrected as shown below:

In Column 10, line 62, delete "2" and insert therefor --9--.

In Column 12, line 24, after "force" insert --for--.

Signed and Sealed this

First Day of December, 1987

*Attest:*

DONALD J. QUIGG

*Attesting Officer*

*Commissioner of Patents and Trademarks*